US011504966B2

(12) United States Patent
Rodriguez-Llorente

(10) Patent No.: US 11,504,966 B2
(45) Date of Patent: Nov. 22, 2022

(54) DETERMINING THE OPERATIONAL STATUS OF A PRINTHEAD

(71) Applicant: Meteor Inkjet Ltd, Cambridge (GB)

(72) Inventor: Fernando Rodriguez-Llorente, Cambridge (GB)

(73) Assignee: Meteor Inkjet Ltd, Cambridge (GB)

( * ) Notice: Subject to any disclaimer, the term of this patent is extended or adjusted under 35 U.S.C. 154(b) by 24 days.

(21) Appl. No.: 17/150,231

(22) Filed: Jan. 15, 2021

(65) Prior Publication Data

US 2021/0221129 A1 Jul. 22, 2021

(30) Foreign Application Priority Data

Jan. 17, 2020 (GB) ..... 2000745

(51) Int. Cl.
*B41J 2/045* (2006.01)
*B41J 2/14* (2006.01)

(52) U.S. Cl.
CPC ..... *B41J 2/04581* (2013.01); *B41J 2/0451* (2013.01); *B41J 2/14201* (2013.01)

(58) Field of Classification Search
CPC ..... B41J 2/0451
See application file for complete search history.

(56) References Cited

U.S. PATENT DOCUMENTS

2008/0136859 A1* 6/2008 Kim ..... B41J 2/04581 347/19
2009/0262161 A1* 10/2009 Nishihara ..... B41J 2/17546 347/19
2012/0249638 A1* 10/2012 Takano ..... B41J 2/0459 347/10
2014/0125722 A1* 5/2014 Otokita ..... B41J 2/04595 347/11
2015/0077455 A1* 3/2015 Morita ..... B41J 2/14209 347/14
2015/0258780 A1* 9/2015 Hayashi ..... B41J 2/04581 347/6

(Continued)

FOREIGN PATENT DOCUMENTS

JP 2002127405 5/2002

OTHER PUBLICATIONS

Combined Search and Examination Report for UK Patent Application No. GB2000745.6, dated Jul. 15, 2020.

*Primary Examiner* — Shelby L Fidler
(74) *Attorney, Agent, or Firm* — Andrus Intellectual Property Law, LLP

(57) ABSTRACT

A system and method for determining the operational status of a nozzle in an inkjet printhead having a piezoelectric actuator configured to cause the ejection of ink through the nozzle, the system comprising: a driving circuit configured to apply a driving signal to the piezoelectric actuator during a first time period; and a sensing circuit configured to measure the current within the piezoelectric actuator as a function of time during a second time period after the first time period; wherein the system is configured to determine the operational status of the nozzle in dependence on the time taken for the measured current to reach a predetermined condition during the second time period, or on the slope of the measured current as a function of time during the second time period.

18 Claims, 7 Drawing Sheets

(56) References Cited

U.S. PATENT DOCUMENTS

| | | | | |
|---|---|---|---|---|
| 2015/0367633 | A1* | 12/2015 | Murate | B41J 2/1412<br>347/10 |
| 2016/0207340 | A1* | 7/2016 | Takano | B41J 2/04588 |
| 2017/0057217 | A1* | 3/2017 | Hayashi | B41J 2/04588 |
| 2018/0370227 | A1 | 12/2018 | Hayashi et al. | |
| 2022/0111634 | A1* | 4/2022 | Ito | B41J 2/21 |

* cited by examiner

DETERMINING THE OPERATIONAL STATUS OF A PRINTHEAD

FIELD OF THE INVENTION

This invention relates to inkjet printers, in particular to apparatus for determining the status of a nozzle in an inkjet piezoelectric printhead.

BACKGROUND

Inkjet printheads may use a piezoelectric actuator to eject ink from a nozzle that is applied to a printing medium.

FIG. 1 shows a schematic illustration of an example of a piezoelectric inkjet printhead. The printhead has a housing 101 which defines a pressure chamber 102. At one end of the pressure chamber is an orifice plate 103, which is located between a slit plate 104 and a path plate 105. At another end of the pressure chamber is an oscillation plate 106 to which a piezoelectric actuator 107 is attached. The printhead also has a channel 108 which supplies ink to the chamber and hence to the nozzle 109. In other printhead designs, the piezoelectric may be attached to the orifice plate or another component of the printhead. In some designs, a pressure chamber is not required to eject ink from the nozzle.

The piezoelectric actuator 107 is connected to a driver circuit which energizes the piezoelectric material in the actuator. PZT (lead zirconate titanate ($Pb[Zr_{(x)}Ti_{(1-x)}O_3]$) is commonly used as the piezoelectric in the actuator.

The piezoelectric can produce work on the nozzle or extract energy from the nozzle by changing the polarization of the molecules of the piezoelectric material. In practice, this transduction effect, converting electrical energy into mechanical energy and vice versa is achieved by placing the piezoelectric material between electrodes. When a voltage is applied to the electrodes an electric field is produced that changes the state of polarization of the piezoelectric material, which causes a change in the dimensions of the piezoelectric material by contracting or expanding its size in some spatial direction. Conversely, when pressure is applied to the piezoelectric, its dimensions change. This changes the polarization of the molecules which in turn changes the surface charge of the material. This change in surface charge can cause an electrical current to flow across the electrodes of the piezoelectric or a change in the voltage across the electrodes, depending on the type of electrical circuit to which the electrodes are connected.

A transfer of energy between the piezoelectric actuator and the fluid in the nozzle occurs whenever there is a change in voltage across its electrodes, or when a current flows across the electrodes. When the energy transfer between the driver and sensing electrical circuits is also considered, the process by which energy is transferred from the electrical driver to the nozzle fluid via the piezoelectric is commonly called nozzle excitation. The process by which energy is transferred between the fluid in the nozzle and the sensing electrical circuit is commonly called nozzle sensing.

Nozzle excitation is commonly performed by applying a voltage function across the electrodes of the piezoelectric 107. Nozzle sensing is commonly performed by measuring the current generated by the piezoelectric across its electrodes when the pressure changes in the nozzle chamber 102. Alternative implementations of these processes are possible by virtue of electrical circuit analysis equivalence theorems. For instance, implementations where the nozzle excitation is performed by applying a current across the electrodes and where nozzle sensing is performed by measuring the voltage across the electrodes are also possible.

In the exemplary printhead shown in FIG. 1, during printing, a pulsed voltage signal is applied to the piezoelectric actuator by the driver circuit in order to rapidly change the volume of the pressure chamber and the piezoelectric actuator consumes current. Movement of the oscillation plate creates pressure waves in the chamber which eject ink from the nozzles at the end or side of the channels. As a result of the pressure waves, a volume of ink contained in the pressure chamber is emitted from the printer head through a passage, the path plate, the orifice plate and the slit plate. The emitted ink travels towards the medium to be printed on as a droplet.

In such printheads, the orifice of the nozzle may become partially or fully blocked. When this occurs, ink droplets cannot be emitted from the printer head correctly. Ejection may be stopped completely, or droplets may be ejected incorrectly, i.e. in the wrong direction. However, even more commonly in practice, a bubble of gas can be formed or accidentally ingested or passed by the ink supply into the chamber through which the pressure wave must pass before it reaches the nozzle. The bubble's contraction, when the pressure wave passes, can absorb or otherwise disrupt the wave, resulting in a weakened pressure wave reaching the nozzle and the ejection of ink is weak or totally prevented.

Known techniques to determine the status of a nozzle utilize the measurement of the frequency of post-jetting current oscillations in the piezoelectric actuator or the decay of the oscillations as observed from the current vs time profile. However, this is computationally complex and requires a relatively long time period after energization of the piezoelectric has ceased in order to make the determination.

It is desirable to develop a faster and less computationally demanding method of detecting the status of a nozzle in an ink jet printer head.

SUMMARY OF THE INVENTION

According to a first aspect there is provided a system for determining the operational status of a nozzle in an inkjet printhead having a piezoelectric actuator configured to cause the ejection of ink through the nozzle, the system comprising: a driving circuit configured to apply a driving signal to the piezoelectric actuator during a first time period; and a sensing circuit configured to measure the current within the piezoelectric actuator as a function of time during a second time period after the first time period; wherein the system is configured to determine the operational status of the nozzle in dependence on the time taken for the measured current to reach a predetermined condition during the second time period.

The predetermined condition may be a threshold current value.

The predetermined condition may be a maximum current value.

The predetermined condition may be when the gradient of the measured current as a function of time is equal to zero.

The predetermined condition may be when the gradient of the measured current as a function of time is equal to zero for the first time during the second period.

The second time period may be separated from the first time period by an intermediate time period.

The time taken for the measured current to reach the predetermined condition may be measured from the end of the intermediate period.

The time taken for the measured current to reach the predetermined condition may be measured from the start of the second period.

The system may further comprise a comparator configured to compare the measured current to the threshold current value.

The system may further comprise a counter configured to measure the time taken for the measured current to reach the predetermined condition.

According to second aspect there is provided a system for determining the operational status of a nozzle in an inkjet printhead having a piezoelectric actuator configured to cause the ejection of ink through the nozzle, the system comprising: a driving circuit configured to apply a driving signal to the piezoelectric actuator during a first time period; and a sensing circuit configured to measure the current the piezoelectric actuator as a function of time during a second time period after the first time period; wherein the system is configured to determine the operational status of the nozzle in dependence on the slope of the measured current as a function of time during the second time period.

The system may further comprise a low noise amplifier.

The operational status of the nozzle may be determined by a logic processor.

The logic processor may be a microprocessor, a CPLD, a FPGA, a Digital Signal Processor, a microcontroller, an embedded PC, a Personal Computer, a server, an ASIC or other programmable logic.

The operational status of the nozzle may be determined using one or more of a set of rules, an algorithm and a look-up table.

The sensing circuit may comprise one or more of a current sensor resistor, a differential operational amplifier, a Hall effect current sensor, a capacitor in series with the piezoelectric actuator and a current mirror.

The operational status may be determined as one or more of normally jetting, deviated jetting, partially blocked, fully blocked and containing an air bubble.

The driving signal may not be applied to the actuator during the second time period.

According to a third aspect there is provided an inkjet printhead comprising: a nozzle; a piezoelectric actuator configured to cause the ejection of ink through the nozzle; and a system as described above.

According to fourth aspect there is provided a method for determining the operational status of a nozzle in an inkjet printhead, the method comprising: applying a driving signal to a piezoelectric actuator during a first time period; measuring the current within the piezoelectric actuator as a function of time during a second time period after the first time period; and determining the operational status of the nozzle in dependence on the time taken for the measured current to reach a predetermined condition during the second time period.

According to a fifth aspect there is provided a method for determining the operational status of a nozzle in an inkjet printhead, the method comprising: applying a driving signal to a piezoelectric actuator during a first time period; measuring the current within the piezoelectric actuator as a function of time during a second time period after the first time period; and determining the operational status of the nozzle in dependence on the slope of the measured current as a function of time during the second time period.

BRIEF DESCRIPTION OF THE FIGURES

The present invention will now be described by way of example with reference to the accompanying drawings.

In the drawings.

DETAILED DESCRIPTION OF THE INVENTION

Figure 1:
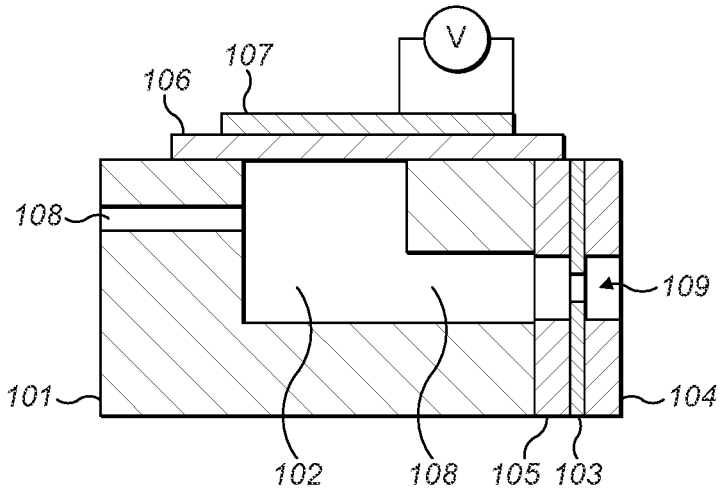
FIG. 1 schematically illustrates a piezoelectric inkjet printhead.
Figure 2:
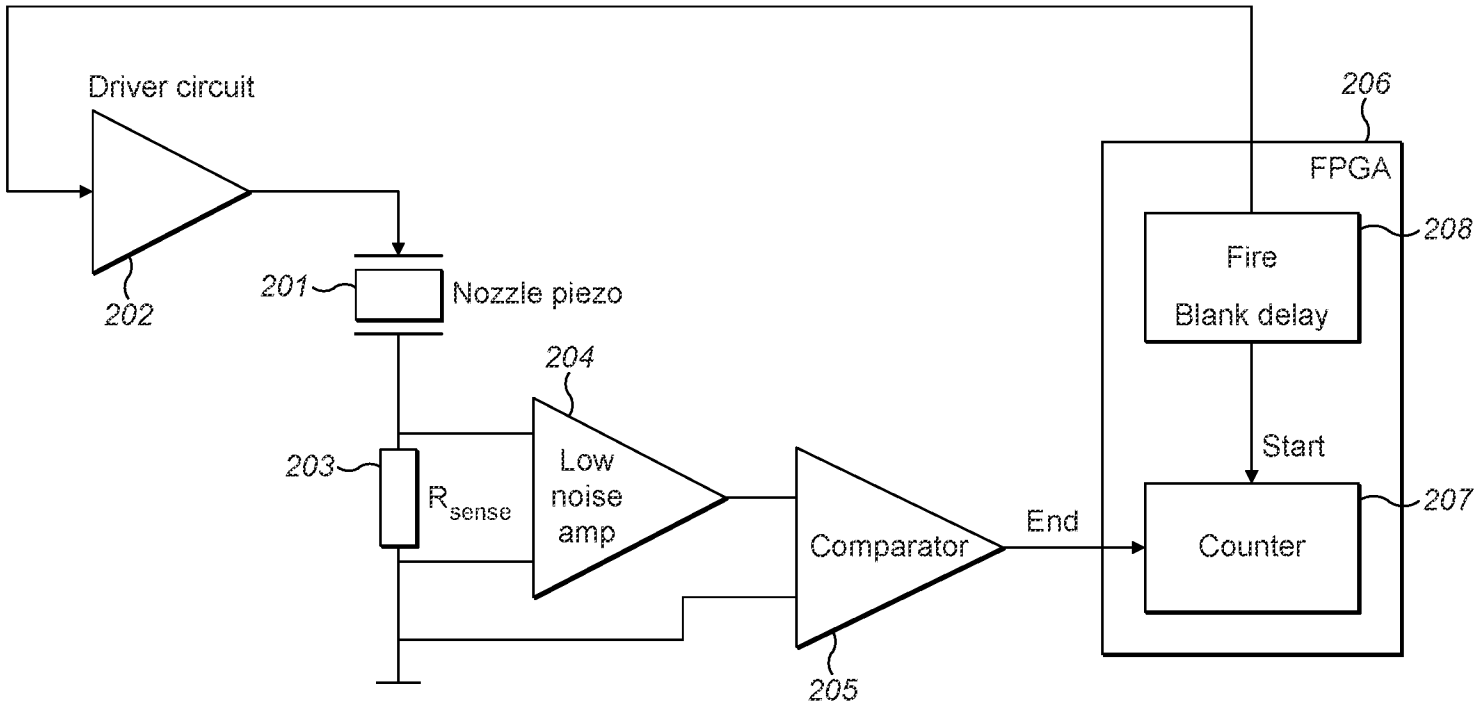
FIG. 2 schematically illustrates apparatus for determining the operational status of an inkjet printhead.

FIG. 2 schematically illustrates apparatus for determining the operational status of a piezoelectric nozzle of a printhead, such as that shown in FIG. 1.

The piezoelectric actuator, comprising a piezoelectric material placed between a pair of electrodes, is shown at 201. The piezoelectric actuator is configured to cause the ejection of ink through the nozzle when a driving voltage of sufficient peak magnitude is applied to the actuator. For simplicity, the rest of the inkjet nozzle is not shown.

The apparatus comprises a driver circuit, shown at 202, which is configured to apply a driving voltage to the piezoelectric actuator. As described in more detail below, during certain time periods, the driver circuit is configured to apply a driving signal, which is a change in voltage, to the piezoelectric actuator. The driving signal is a voltage profile, normally referred to as a waveform, applied to the piezoelectric with the purpose of producing a mechanical action on the nozzle chamber. Application of the driving signal to the piezoelectric actuator causes a change in the dimensions of the piezoelectric material. The driving signal may be described as a sequence of voltage hold values and slope (dV/dt) values to transition between hold values. It may be described as a "trapezoidal" profile. However, the driving signal may be any suitable mathematical function.

The apparatus also comprises a sensing circuit 203. The sensing circuit is configured to measure the electrical current within the piezoelectric actuator in the inkjet printhead. When the piezoelectric actuator is being energized by the driver circuit, electrical current is consumed by the piezoelectric. When the piezoelectric actuator is not being driven by the driver circuit, the piezoelectric actuator generates current as a result of the pressure drop in the chamber (which causes movement of the piezoelectric material). The current measured by the sensing circuit may include current generated by the piezoelectric actuator as a result of movement of the piezoelectric material and/or current otherwise present in the piezoelectric actuator, i.e. the sensing circuit measures the current flowing in the piezoelectric actuator at a given time. The sensing circuit 203 could be implemented as a current sensor resistor and a differential operational amplifier, a Hall effect current sensor, a capacitor in series with the nozzle piezo, a current mirror or other commonly used circuit used to detect electrical currents.

The apparatus further comprises a low noise amplifier 204, a voltage comparator 205 and a logic processor 206.

The low noise amplifier 204 is configured to amplify the current signal measured by the sensing circuit 203. The output from the low noise amplifier 204 is input to the voltage comparator 205.

The voltage comparator 205 could be implemented as a single commercially available circuit or as a combination of an analogue to digital converter (ADC) and a microprocessor or field-programmable gate array (FPGA). The comparator 205 may be implemented as an electronic circuit element or as an algorithm running on a logic processor. Although FIG. 2 shows the comparator 205 as a discrete element in a circuit, it may be constructed in a number of different ways. The logic processor may be a device such as a microprocessor, a complex programmable logic device (CPLD), a FPGA, a digital signal processor (DSP), a microcontroller, an embedded PC, a Personal Computer, a server, an ASIC, or other programmable logic. In the embodiment shown in FIG. 2, the logic processor includes a timer circuit 207, shown in FIG. 2 as a counter. The timer circuit may typically be implemented as a CPLD, FPGA, or microprocessor. The logic processor also includes a delay 208 used to avoid signals captured while the operational amplifier is settling its output voltage after a nozzle excitation pulse being used for the nozzle status determination.

Nozzle excitation is commonly performed by applying a voltage function across the electrodes of the piezoelectric actuator 201. Nozzle sensing is commonly performed by measuring the current generated by the piezoelectric across its electrodes when the pressure changes in the nozzle chamber (102 in FIG. 1). This is the preferred approach used in the present invention. Alternative implementations of these processes are possible by virtue of electrical circuit analysis equivalence theorems. For instance, an implementation where the nozzle excitation is performed by applying a current across the electrodes and where nozzle sensing is performed by measuring the voltage across the electrodes.

There are some practical advantages in converting the current generated by the piezoelectric into a voltage. With reference to nozzle shown in FIG. 1, the current generated by the piezoelectric may be converted to an equivalent voltage by placing a resistor 203 in series with the piezoelectric transducer 201. By Ohms law, there is a proportional relationship between this current and this voltage, and in this document, the terms sensing current and sensing voltage will be used as equivalents. In some embodiments of the present invention, an electrical component or circuit that is not a resistor may be used to convert the sensing current into a voltage. A particularly relevant case is when a capacitor is used in place of resistor 203. In these cases, the relationship between sensing current and voltage is not proportional and the appropriate mathematical expression for the component or circuit equivalent impedance is used.

Figure 3A:
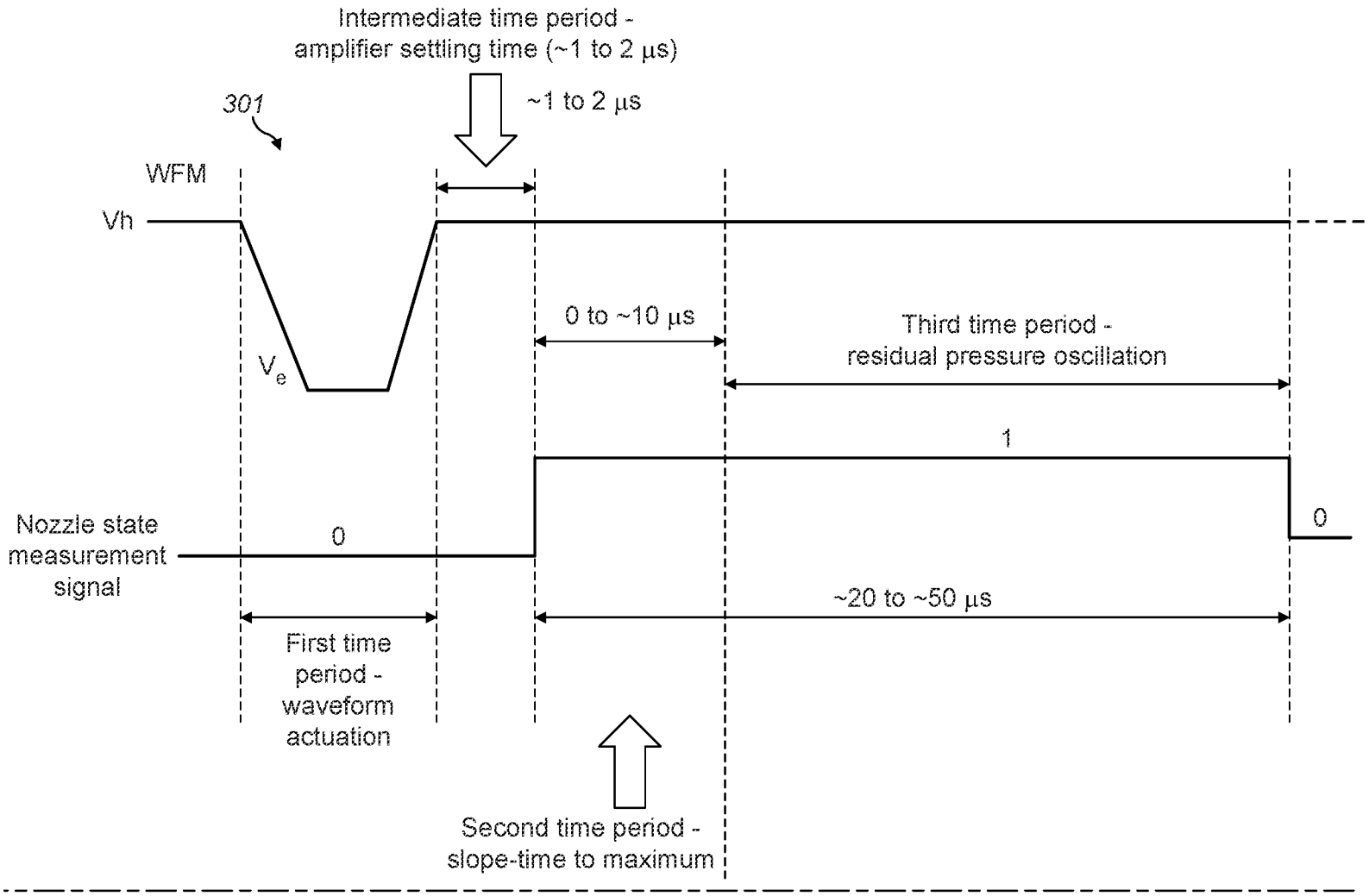
FIG. 3A schematically illustrates the signals applied to the apparatus as a function of time.
Figure 3B:
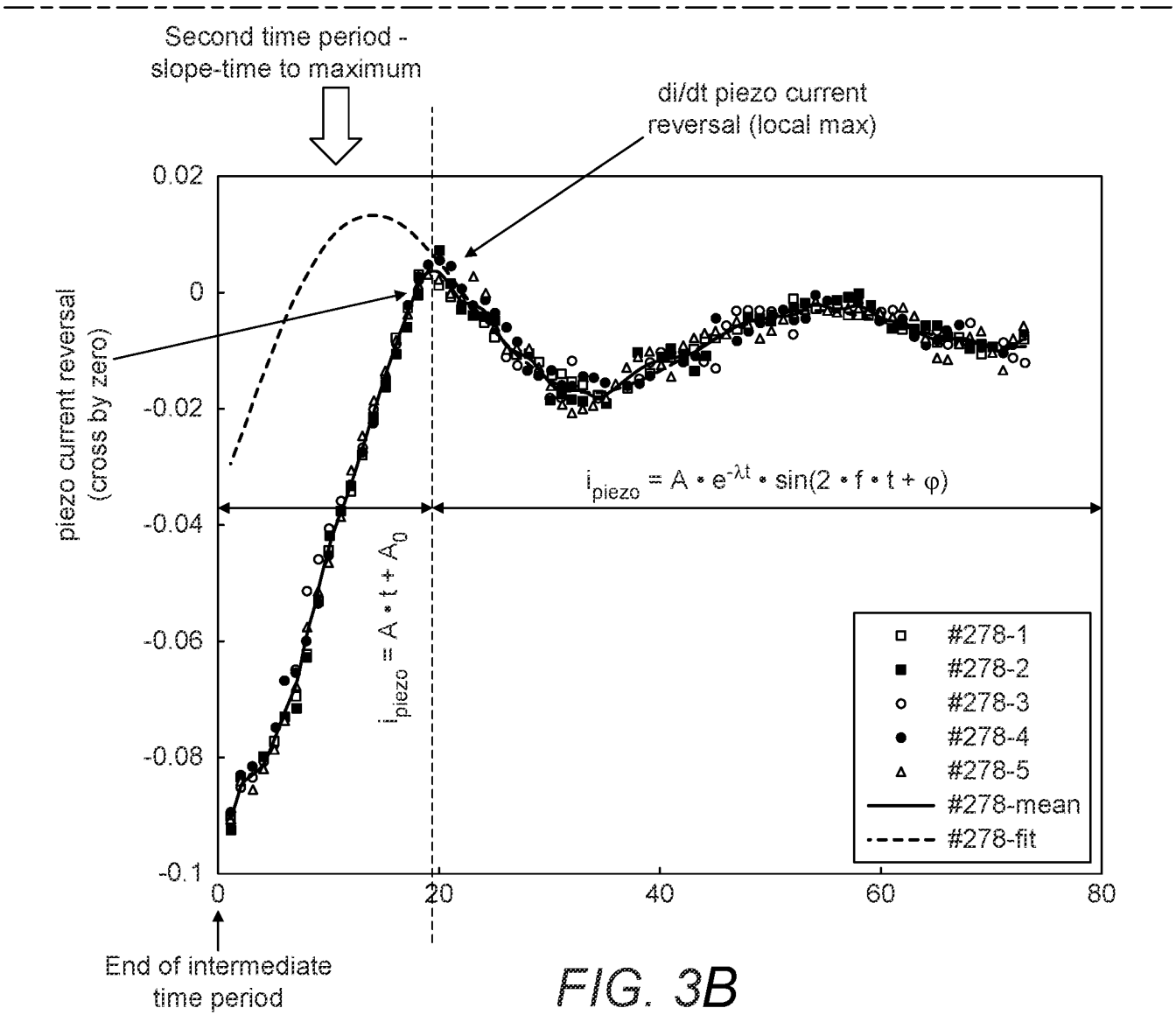
FIG. 3B shows a graph of the current within the piezoelectric versus time after the end of the driving signal.

FIG. 3(*a*) schematically illustrates the signals supplied to the apparatus to determine the operational status of the nozzle as a function of time. FIG. 3(*b*) shows a corresponding graph of current within the piezoelectric, as measured by the sensing circuit 203, as a function of time (in sample units) for some corresponding sections of FIG. 3(*a*).

As shown in FIG. 3(*a*), during a first time period, the driving circuit 202 applies a driving signal to the piezoelectric actuator. The driving signal is indicated generally at 301. The driving signal comprises a change in driving voltage. The change in voltage provided by the driving signal is sufficient to energize the piezoelectric actuator. The driving signal may be in the form of a voltage pulse. The waveform of the driving signal may have a trapezoidal profile. In FIG. 3(*a*), the driving signal comprises a slope (dV/dt) value to transition from a hold value $V_h$ to a hold value $V_e$ which changes the shape of the piezoelectric before returning via another slope to hold value $V_h$ which returns the shape of the piezoelectric to its previous shape. These changes in shape change the volume of the nozzle chamber, which in turn changes the pressure in the fluid of the chamber, producing some work on the fluid (energization of the nozzle), which may ultimately lead to the jetting of a drop of ink if $V_e$ is sufficient. The voltage hold section $V_h$ is a section of the waveform where the voltage does not change. The hold voltages can be any value: zero voltage, positive voltage or negative voltage. Conversely to the energization effect above, a change in the pressure of the fluid causes a change in the shape of the nozzle chamber and piezo element, producing some work on the piezo element (de-energization of the nozzle), which in turn causes the piezoelectric to generate an electrical current.

The driving voltage is therefore the voltage applied to the piezoelectric at a given time, the driving signal is the changing voltage that causes energization of the piezoelectric for the purpose of state determination and the hold voltage ($V_h$ in FIG. 3(*a*)) is the baseline. The nozzle state determination is performed during a hold voltage period, when the pressure changes in the nozzle chamber are affected by the operational status of the overall nozzle structure.

The driving signal applied to the piezoelectric actuator for the nozzle status determination may have a peak magnitude sufficient to jet a drop of ink, or it may not be sufficient to jet a drop of ink. The peak voltage of the driving signal (e.g. $V_e$ in FIG. 3(*a*)) used to energize the piezoelectric of a nozzle for the purpose of determining its status does not necessarily need to be the same as the one used for printing. However, the status determination may also be performed after printing had ceased and the driving signal may correspond to the driving voltage applied to the actuator during printing. The approach described herein can be performed during any constant voltage segment following energization of the piezoelectric, provided it is long enough in time to carry out the measurement before the piezoelectric is energized again.

Application of the driving signal may cause ejection of ink if the peak magnitude of the driving signal exceeds an ejection voltage. The ejection voltage is a threshold voltage value which corresponds the voltage sufficient to cause the ejection of ink from the nozzle. The piezoelectric actuator is therefore configured to cause the ejection of ink through the nozzle when a driving voltage which exceeds the ejection voltage is applied to the actuator.

The apparatus also receives a measurement signal that, in the example shown in FIG. 3(*a*), has two levels: 0 and 1, corresponding to no measurement of the current within the piezoelectric and measurement of the current of the current within the piezoelectric respectively. During the first time period, the measurement signal is at 0.

In the example of FIG. 3(*a*), following the first time period during which the driving signal is applied, there is an intermediate time period during which the amplifier and/or parameters settle following the return of the drive voltage to the hold value $V_h$ after the driving signal has been applied. In some implementations, the intermediate time period may be zero seconds. However, typically the intermediate time period is approximately 1 to 2 μs in duration. The intermediate time period after the end of the driving signal waveform actuation is therefore a time period during which the measured current within the piezoelectric may not be reliable to use for state determination. It is desirable to wait for the electronics to settle and not make the measurement until after the end of the intermediate period. During the intermediate time period, the measurement signal is at 0.

Following the intermediate time period is a second time period during which the operational status of the nozzle is determined. During the second time period, the measurement signal is at 1, as shown in FIG. 3(*a*). During the second time period, the driving circuit 202 does not apply the driving signal to the actuator but applies a voltage hold (i.e. a constant voltage) to the piezoelectric.

The status determination is therefore performed during the second time period, which begins a fixed time (corresponding to the intermediate time period) after the end of the waveform excitation (the end of the last slope of the driving signal).

The constant voltage applied to the piezoelectric during the second time period may be a positive voltage, a negative voltage or zero voltage. The voltage applied to the piezoelectric during the second time period is normally the same as the voltage applied to the piezoelectric before application of the driving signal.

During the second time period, the driving signal is not applied to the piezoelectric actuator. During the second time period, the voltage applied to the piezoelectric actuator is constant. During the second time period, the piezoelectric generates an electrical current as the nozzle chamber of the printhead changes shape following the removal of the driving signal. The current as a result of the energization the piezoelectric actuator corresponding to the maximum applied voltage of the driving signal ($V_e$ in the example of FIG. 3(*a*)) is approximately six orders of magnitude higher than the current generated by the piezoelectric after it has been energized.

A third time period follows the second time period. During the third time period, there are residual pressure oscillations in the piezoelectric. During the third time period, the driving signal is not applied to the piezoelectric actuator. During the third period, the voltage applied to the piezoelectric is constant. The constant voltage applied to the piezoelectric during the third period may be a positive voltage, a negative voltage or zero voltage. The voltage applied to the piezoelectric during the third period is preferably the same as the voltage applied during the second period. In the present invention, the variations in current during the third time period are not used to determine the operational status of the nozzle. During the third time period, the measurement signal may be at 1, as shown in FIG. 3(*a*), or it may be at 0.

There are therefore four time windows in a measurement cycle: a first time period (driving signal waveform actuation time, i.e. the driving signal is applied to piezoelectric), an intermediate time period (amplifier settling time), a second time period (the slope-time to maximum measurement time) and a third time period (residual pressure oscillation time). The measurement of current within the piezoelectric in order to determine its state is made during the second time period, when the piezoelectric is being de-energized. The method does not use measurements of current during the third time period, when there are residual pressure oscillations, to determine the state of the nozzle.

Further details of how the current within the piezoelectric actuator in an inkjet printhead during the second time period can be monitored to determine the status of the nozzle will now be described.

In one embodiment, the system determines whether the measured current during the second period is above a certain threshold. The threshold may be a predetermined threshold. The voltage comparator 205 can use the current measured by the sensing circuit 203 to determine whether the piezoelectric current is above or below the threshold. In this embodiment, the time period from the end of the intermediate time period (after the electronics have settled) until the threshold current value is reached is measured. The time taken to reach the predetermined threshold may typically be between 2 to 10 μs. Timer circuit 207 is used to measure the time period between the end of the intermediate period and the time at which the piezoelectric current crosses the threshold when the piezoelectric is being de-energized during the second time period. The time taken to reach the current threshold can be used to determine the status of the nozzle, as will be described in more detail below.

In another embodiment, the system determines whether the measured current during the second period has reached a local maximum. The time period from the end of the intermediate time period until the local maximum is reached is measured. The voltage comparator 205 can use the current measured by the sensing circuit 203 to determine whether the piezoelectric current has reached a local maximum. The voltage comparator may be configured to detect when such a current has reached a local maximum. The system may determine the local maximum current has been reached by determining the derivative of current versus time. The local maximum is reached when the derivate of current with respect to time is equal to zero. The local maximum may additionally be detected when di/dt reverses, i.e. changes from positive to negative, or vice versa. The local maximum of interest is when the derivative is equal to zero, or when di/dt reverses, for the first time during the second period. The time taken to reach the local maximum from the end of the intermediate time period may typically be between 2 to 10 μs. Timer circuit 207 is used to measure the time period between the end of the intermediate period and the time at which the local maximum is reached when the piezoelectric is being de-energized during the second time period. The time taken to reach the local maximum can be used to determine the status of the nozzle, as will be described in more detail below.

In a further embodiment, the system determines the slope (i.e. the gradient, the derivative of the current with respect to time) of the current versus time graph during the second period. The system may determine the slope of the graph between the end of the intermediate settling period and the first local maximum in the current versus time graph during the second time period. Alternatively, the system may determine the slope of a smaller section (in time) of the current versus time graph during the second period. The determined slope can be used to determine the status of the nozzle, as will be described in more detail below.

Once the time period to reach the predetermined condition, or the slope of the current versus time graph, has been determined, logic processor 206 can make a determination of the status of the nozzle based on the value of the slope or the time taken for the threshold value or local maximum to be reached.

The operational status of the nozzle may be determined using one or more of a set of rules, an algorithm and a look-up table. For example, the measured value of the time taken to reach the predetermined condition or the slope of the current versus time graph may be input into an algorithm which outputs the status based on the input. The measured value of the time taken to reach the predetermined condition or the slope of the current versus time graph may be used to look up a corresponding status in a lookup table.

Figure 4A:
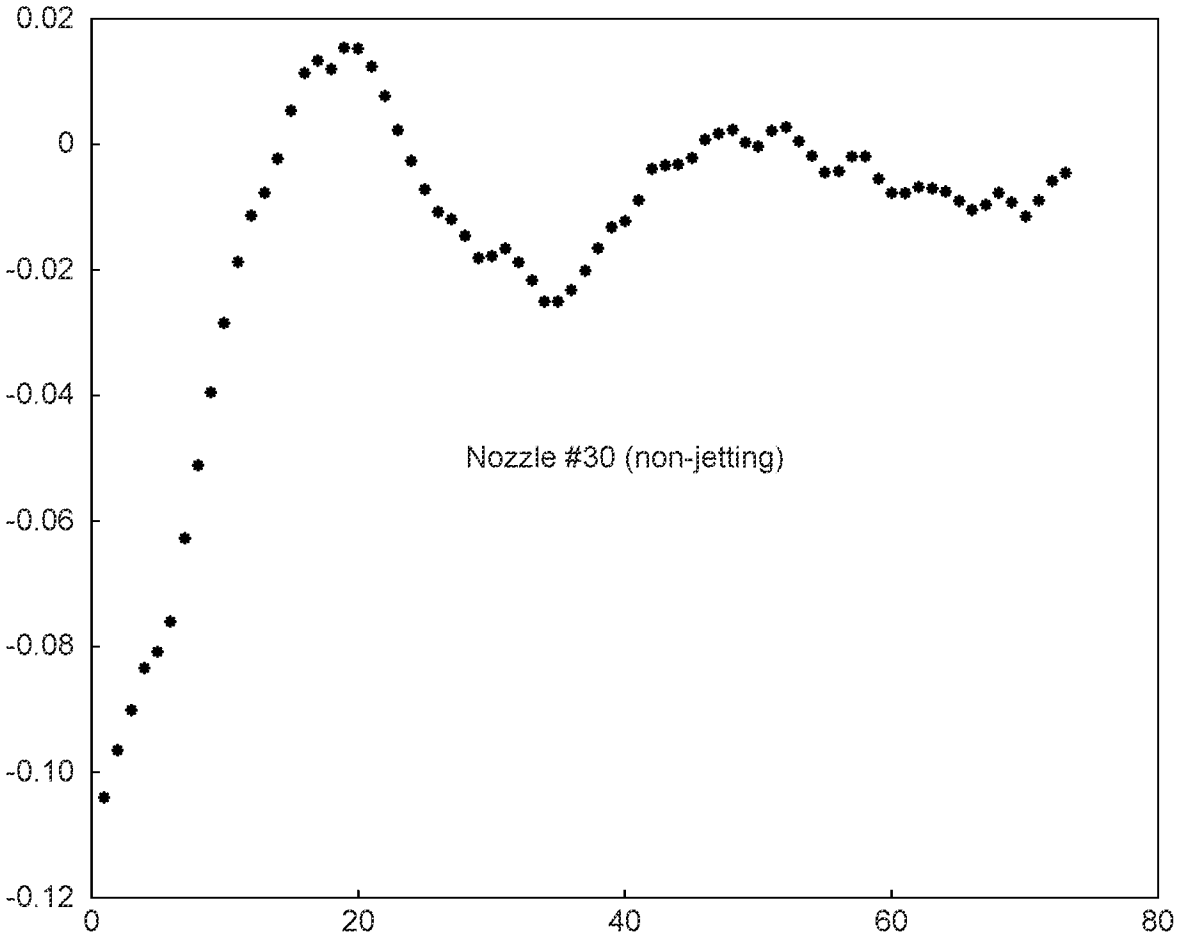
FIG. 4A illustrates an example of a current versus time graph for a non-jetting printhead.
Figure 4B:
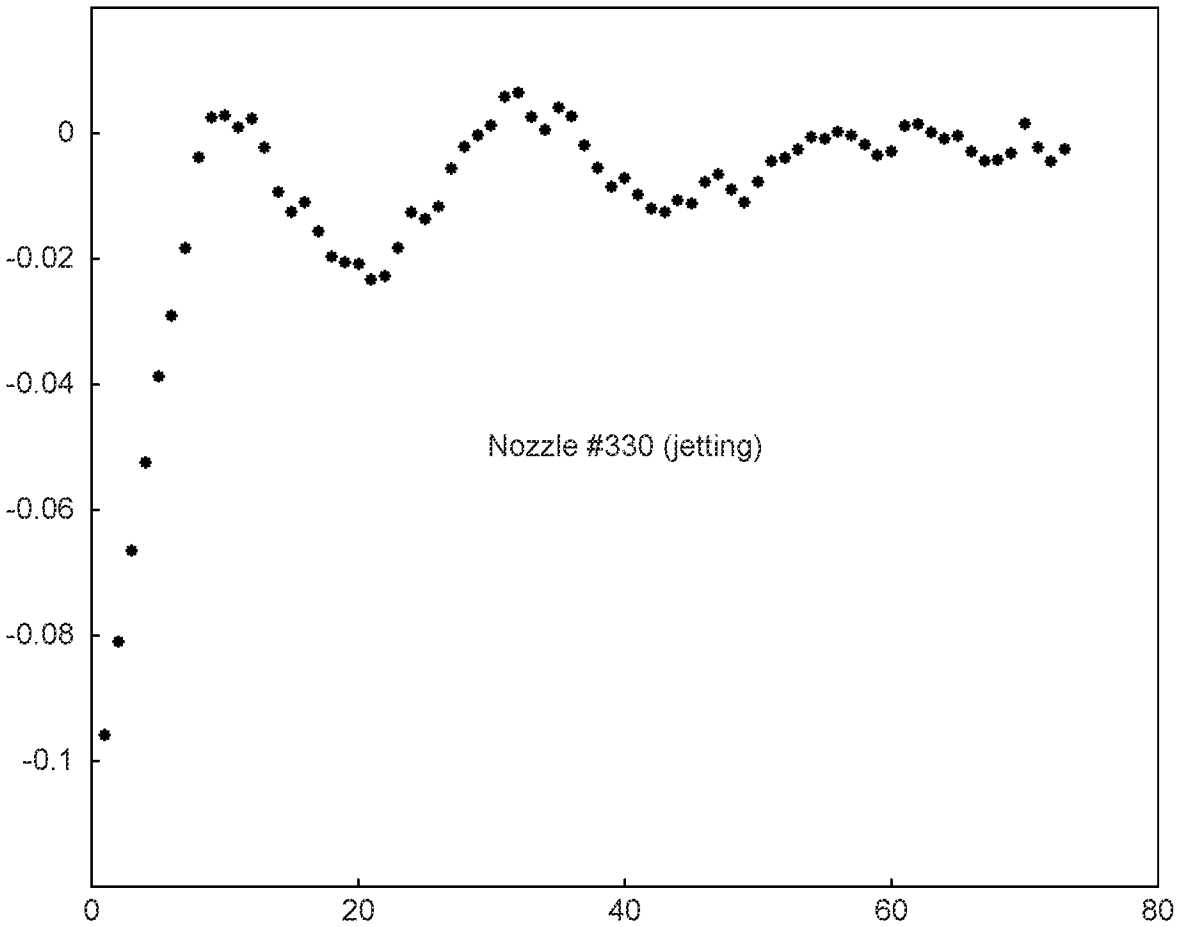
FIG. 4B illustrates an example of a current versus time graph for a jetting printhead.

FIGS. 4(*a*) and 4(*b*) show examples of current versus time graphs for printhead nozzles having different operational statuses. In this example, the slope of the graphs was used to determine the operational status of the nozzle. FIG. 4(*a*) shows a current versus time graph after the end of the intermediate time period for a non-jetting nozzle and FIG. 4(*b*) shows a current versus time graph for a jetting nozzle. The slope of the current versus time graph during the second time period for the jetting nozzle has a greater value than the slope for the non-jetting nozzle.

The status of the nozzle may be described as normally jetting, deviated jetting, partially blocked, fully blocked, containing an air bubble and other statuses or by a combination of any of the previous statuses. Each operational status may correspond to a different discrete value or a different range of values of the time taken to reach the predetermined condition or a different discrete value or a range of values of the slope of the current versus time graph during the second time period.

The system may be configured to output the determined status to a user of the printer containing the inkjet printhead. The system may send a status signal to a processor of the printer. The signal may cause the status to be communicated a user of the printer. For example, the status may be displayed on a display element of the printer, such as a user interface, which may be an LCD screen or similar element, or transmitted to a PC or server using a suitable communication protocol such as TCP-IP (Internet Protocol).

Figure 5:
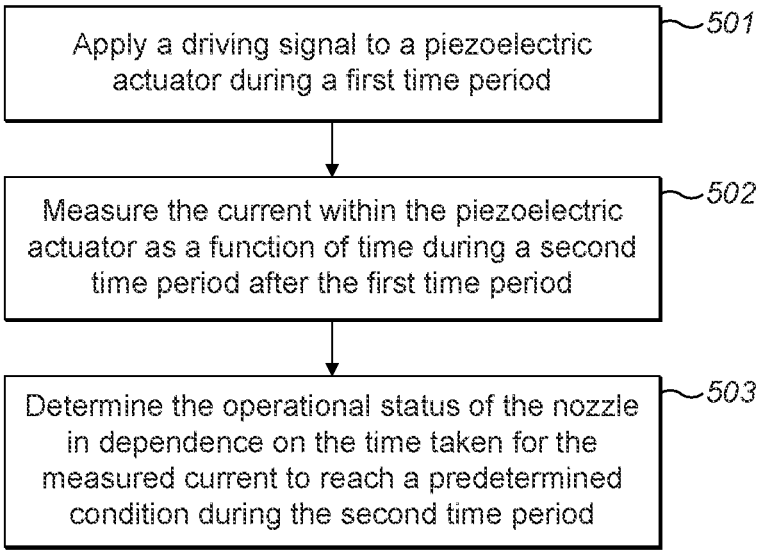
FIG. 5 illustrates a method for determining the operational status of a nozzle in an inkjet printhead.

FIG. 5 summarises one embodiment of a method for determining the operational status of a nozzle in an inkjet printhead. At step 501, the method comprises applying a driving signal to a piezoelectric actuator during a first time period. At step 502, the method comprises measuring the current within the piezoelectric actuator as a function of time during a second time period after the first time period. At step 503, the method comprises determining the operational status of the nozzle in dependence on the time taken for the measured current to reach a predetermined condition during the second time period.

Figure 6:
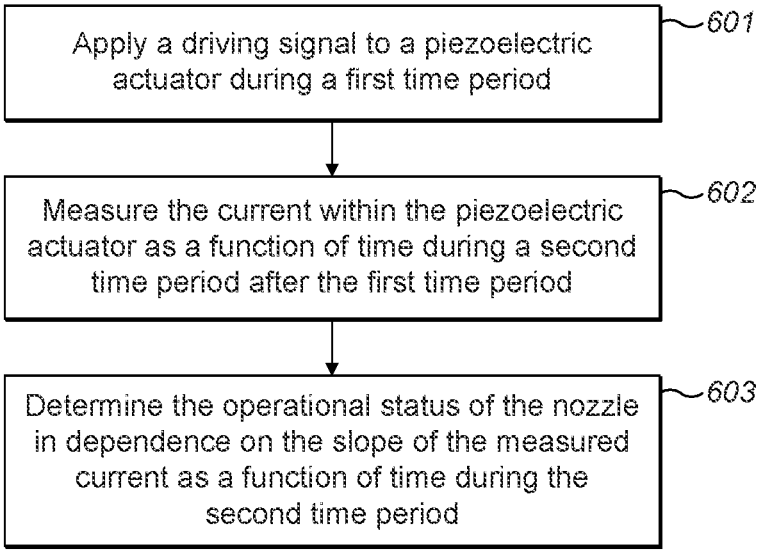
FIG. 6 illustrates another method for determining the operational status of a nozzle in an inkjet printhead.

FIG. 6 summarises another embodiment of a method for determining the operational status of a nozzle in an inkjet printhead. At step 601, the method comprises applying a driving signal to a piezoelectric actuator during a first time period. At step 602, the method comprises measuring the current within the piezoelectric actuator as a function of time during a second time period after the first time period. At step 603, the method comprises determining the operational status of the nozzle in dependence on the slope of the measured current as a function of time during the second period.

The described method may be used between print jobs to determine the nozzle status. Alternatively, the described method may be used after a maintenance operation to check that maintenance (for example, cleaning of the nozzles) has been completed successfully. The method could also be performed during the print job itself, where the peak voltage of the driving signal is sufficient to eject a droplet of ink from the nozzle (i.e. where the driving voltage exceeds the ejection voltage threshold).

A printhead may contain a plurality of piezoelectric nozzles. The status determination apparatus may be sequentially connected to the piezoelectric actuator of each nozzle of the printhead. This may be done using a switching circuit.

Using the methods described above, it may be possible to determine the status of the printhead more quickly after energization of the piezoelectric nozzle than is possible using prior art methods. For example, status determination using the frequency or decay rate of the current versus time profile requires a longer time period after the driving signal has ceased in which to make the measurement, because multiple periods of the oscillation are required. The presently described method only requires the time period up to the first local maximum in the current versus time graph in order to make the status determination.

Furthermore, measuring these characteristics of the current-time characteristic is much simpler than measuring frequency or decay rate of the current within the piezoelectric as a function of time.

As a result, the operational status of the printhead nozzle may be obtained more quickly and in a less computationally demanding manner.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A system for determining the operational status of a nozzle in an inkjet printhead having a piezoelectric actuator configured to cause the ejection of ink through the nozzle, the system comprising:

a driving circuit configured to apply a driving signal to the piezoelectric actuator during a first time period; and a sensing circuit configured to measure the current within the piezoelectric actuator as a function of time during a second time period after the first time period and before a third time period during which residual pressures oscillate in the piezoelectric actuator;

wherein the system is configured to determine the operational status of the nozzle in dependence on the measured current as a function of time during the second time period without dependence on a current measured during the third time period; and wherein the driving signal is held constant for the duration of the second time period.

2. A system as claimed in claim 1, wherein the measured current as a function of time during the second time period is a slope of the measured current.

3. A system as claimed in claim 1, wherein the operation status of the nozzle is in dependence on the time taken for the measured current as a function of time to reach a predetermined condition during the second time period.

4. A system as claimed in claim 3, wherein the predetermined condition is one of: a threshold current value; a maximum current value; when the gradient of the measured current as a function of time is equal to zero; or when the gradient of the measured current as a function of time is equal to zero for the first time during the second period.

5. A system as claimed in claim 4, wherein the predetermined condition is the threshold current value and the system further comprises a comparator configured to compare the measured current to the threshold current value.

6. A system as claimed in claim 3, wherein the second time period is separated from the first time period by an intermediate time period.

7. A system as claimed in claim 6, wherein the time taken for the measured current to reach the predetermined condition is measured from the end of the intermediate period.

8. A system as claimed in claim 3, wherein the time taken for the measured current to reach the predetermined condition is measured from the start of the second period.

9. A system as claimed in claim 3, wherein the system further comprises a counter configured to measure the time taken for the measured current to reach the predetermined condition.

10. A system as claimed claim 3, wherein the system further comprises a low noise amplifier.

11. A system as claimed in claim 3, wherein the operational status of the nozzle is determined by a logic processor.

12. A system as claimed claim 3, wherein the operational status of the nozzle is determined using one or more of a set of rules, an algorithm and a look-up table.

13. A system as claimed in claim 3, wherein the operational status is determined as one or more of normally jetting, deviated jetting, partially blocked, fully blocked and containing an air bubble.

14. A system as claimed in claim 3, wherein the driving signal is not applied to the actuator during the second time period.

15. An inkjet printhead comprising:

a nozzle;

a piezoelectric actuator configured to cause the ejection of ink through the nozzle; and a system according to claim 3.

16. A method for determining the operational status of a nozzle in an inkjet printhead, the method comprising:

applying a driving signal to a piezoelectric actuator during a first time period;

measuring the current within the piezoelectric actuator as a function of time during a second time period after the first time period and before a third time period during which residual pressures oscillate in the piezoelectric actuator;

holding the driving signal constant for the duration of the second time period; and determining the operational status of the nozzle in dependence on the measured current as a function of time during the second time period without dependence on a current measured during the third time period.

17. A method according to claim 16, wherein the measured current as a function of time is a time taken to reach a predetermined condition during the second time period.

18. A method according to claim 16, wherein the measured current as a function of time is a slope of the measured current.

* * * * *